US006398008B1

(12) United States Patent
Suga

(10) Patent No.: US 6,398,008 B1
(45) Date of Patent: Jun. 4, 2002

(54) ALIGNING AND CONVEYING METHOD OF PACKAGED ARTICLE AND APPARATUS THEREOF

(75) Inventor: Tadoru Suga, Ibaraki (JP)

(73) Assignee: Ibaraki Seiki Machinery Co., Ltd., Ibaraki (JP)

( * ) Notice: Subject to any disclaimer, the term of this patent is extended or adjusted under 35 U.S.C. 154(b) by 0 days.

(21) Appl. No.: 09/625,763

(22) Filed: Jul. 26, 2000

(51) Int. Cl.[7] ..... B65G 47/24

(52) U.S. Cl. ..... 198/404; 198/408; 414/419; 414/405; 414/764

(58) Field of Search ..... 198/404, 408, 198/409; 414/419, 405, 764, 765, 766

(56) References Cited

U.S. PATENT DOCUMENTS 1,253,748 A * 1/1918 Tyson
1,956,192 A * 10/1934 Donnelly ..... 25/1
3,854,613 A * 12/1974 Renfrow ..... 214/314
4,128,377 A * 12/1978 Bramati ..... 425/439
4,354,788 A * 10/1982 Giusti ..... 414/55
4,699,564 A * 10/1987 Cetrangolo ..... 414/765
4,798,278 A * 1/1989 Cornacchia ..... 198/399

FOREIGN PATENT DOCUMENTS

JP 54111989 A * 9/1979 ..... 414/419

* cited by examiner

*Primary Examiner*—Paul N. Dickson
*Assistant Examiner*—Melody M. Burch
(74) *Attorney, Agent, or Firm*—Reising, Ethington, Barnes, Kisselle, Learman & McCulloch, P.C.

(57) ABSTRACT

An apparatus for mechanically taking out packaged articles housed in a large-sized tray onto a conveyer line. A tray housing a multiplicity of packaged articles is conveyed onto a support conveyer bridging between a pair of side plates, the packaged articles are pressed inside the tray by lowering a support plate, then the side plates are rotated for 180 degrees around a main shaft with the packaged articles kept in the same pressed condition, the support plate is lowered integrally with the packaged articles at a determined position, and the emptied upside-down tray is discharged outside along rails attached to the inner surfaces of the side plates. Thereafter, while being pressed to the upper support conveyer, the packaged articles are returned to an original lower position by rotating the side plates and discharged outside by rotating the support conveyer.

5 Claims, 6 Drawing Sheets

ALIGNING AND CONVEYING METHOD OF PACKAGED ARTICLE AND APPARATUS THEREOF

FIELD OF THE INVENTION

The present invention relates to a method for taking out a batch of packaged articles from a large-sized tray housing a multiplicity of packaged articles and conveying them in a predetermined direction, and to an apparatus for executing the method.

BACKGROUND OF THE INVENTION

When a multiplicity of packaged products or packaged articles housed in a large-sized tray are conveyed to a warehouse, a system installed in the warehouse operates to take out these individual packaged articles from the tray onto the conveyer line, recycle the tray, sort the packaged articles by kind or type from the conveyer line to branch conveyers, attach a price tag to each article, and box the packages. Generally used system is such that a catching robot turns over the large-sized tray to release individual packaged articles in the tray onto a floor and workers on stand start to assort the packages. As more efficient means, there is another system in which when a large-sized tray with packaged articles housed in a stacked fashion inside the tray halts at a specified position, a group of a multiplicity of vacuum cups descend from an upper location of the tray into the tray several times to suck the multiplicity of packaged articles housed therein to successively carry them out onto the conveyer line. It is only seldom but some of the vacuum cups, however, fail to properly suck the packaged articles due to distortion or surface unevenness of the articles, causing one or more articles to be left behind in the large-sized tray. Further, if the packaged articles are stacked in several tiers in the large-sized tray, all the packaged articles cannot be taken out at a time. Thus, the system has a problem of inefficiency in one aspect.

SUMMARY OF THE INVENTION

In order to take out many packaged articles out of a large-sized tray efficiently and free of mistakes, the present invention comprises: a pair of side plates integrally rotating around a horizontal traverse main shaft as a support shaft; a pair of support conveyers arranged to extend at an upper location and a lower location with respect to the main shaft, each bridging between the side plates; a pair of support plates disposed between the side plates and opposing the pair of support conveyers respectively; means for conveying a tray from outside into a space between the lower support conveyer and a pair of rails fixed to the inner surfaces of the side plates; an actuator for pushing the support plate into the tray to press the packaged articles inside the tray while the side plates rotate for 180 degrees and thereafter lowering the support plate together with the packaged articles to the outside of an upside-down tray at an upper halt position; means for discharging outside the upside-down tray along the rail with the packaged articles supported on the support plate being left behind; means for rotating the side plate for 180 degrees while pushing the packaged articles on a support plate to the upper support conveyer by means of the actuator after the upside-down tray has been discharged; and means for conveying outside the packaged articles returned to a lower area by the rotation of the support conveyer.

According to the above described apparatus, when the packaged articles housed in a tray are conveyed into the support conveyer at the lower location, a support plate descends onto each tray and the tray rotates for 180 degrees with the support plate pressing thereon. Then, the tray is conveyed to an upper area, while the support plate presses the packaged articles to prevent them from scattering. And the packaged articles are loaded on the support plate at the upper area and lowered as if drawn out from a large-sized tray. After the emptied tray is discharged outside, the packaged articles are raised to be pressed to the support conveyer at the upper location and returned to the lower area. In brief, even packaged articles stacked in many tiers inside the tray can be batch-processed collectively with high efficiency. In addition, mistakes included in the processing can be minimized as compared to those occurring in the processing using vacuum cups.

DESCRIPTION OF THE EMBODIMENTS

Figure 1:
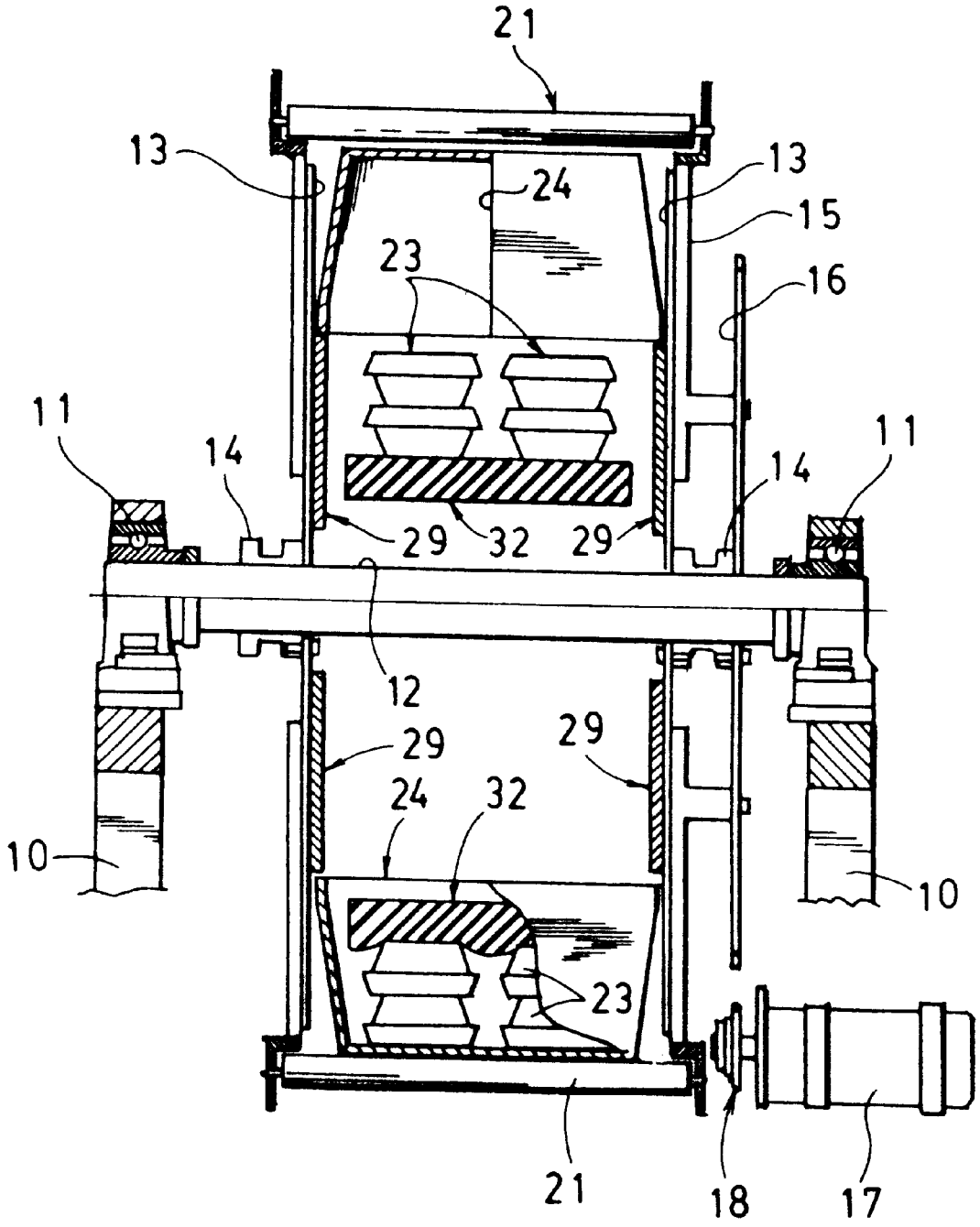
FIG. 1 is a sectional view of an apparatus of the invention as seen from the side thereof.
Figure 2:
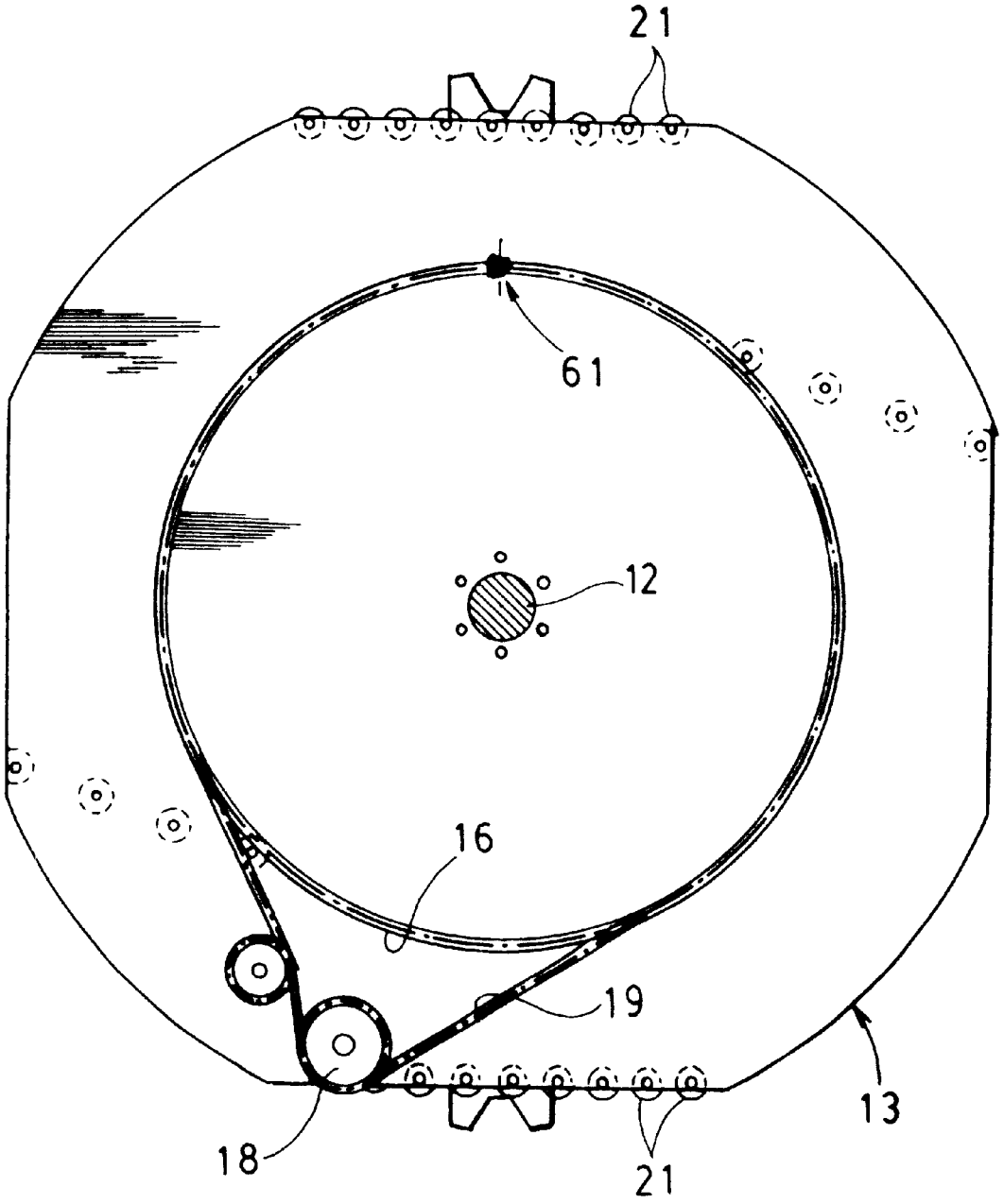
FIG. 2 is a front view of the apparatus.

As shown in FIG. 1, a main shaft 12 is rotatably supported between bearings 11 respectively fixed on a pair of machine stands 10 disposed on both sides, and a pair of side plates 13 are fixed onto the main shaft 12 via bushes 14 with a predetermined distance kept from the main shaft. Moreover, a large gear wheel 16 is supported via a frame 15 fixed outside the side plate on one side, and a pinion 18 fixed to the shaft of a motor 17 and the large wheel gear 16 are linked together via a chain 19 as shown in FIG. 2. Thus, when the rotary power of the pinion 18 is delivered to the gear wheel 16 by means of the chain 19, the side plates 13 rotate together with the main shaft 12. In this case, the side plates 13 may be so configured as to rotate around a fixed-type main shaft 12.

Besides, there are provided between the side plates 13 a pair of support conveyers 21 each in a bridged fashion and comprising a multiplicity of rollers. Each of these support conveyers is a device commonly called as motor roller which is equipped with motors in part of the rollers thereof, and in addition the rollers are linked together with a belt, so that all the rollers rotate integrally in the same direction. It should be noted that the support conveyer 21 may be comprised of a belt conveyer instead of a combination of a multiplicity of rollers as shown in the figures, to obtain similar effects and advantages.

Figure 3:
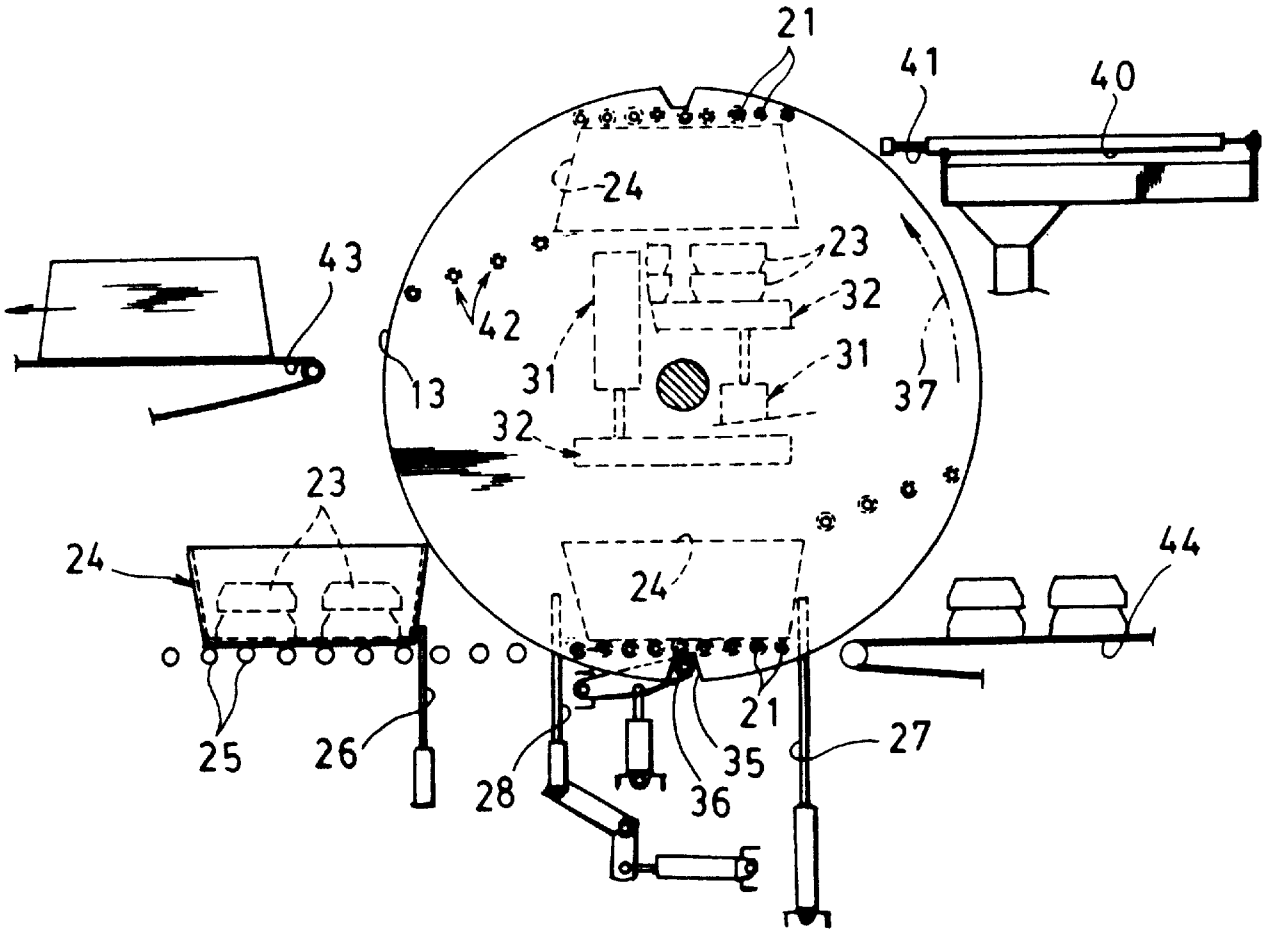
FIG. 3 is an overall front view of the apparatus.

Disposed at the same height as with the support conveyer 21 at a lower location as shown in FIG. 3 is a conveyer, i.e. conveyance means 25 for supplying a tray 24 with a multiplicity of packaged articles 23 housed therein from the outside toward the support conveyer 21. When a hindrance by a first stopper 26 is removed, the conveyance means 25 and the conveyer 21 at the lower location convey a tray 24 to a position butting against a second stopper 27. As seen from FIG. 4, the tray 24 moves in an arrow-headed direction 80 and halts on the conveyer 21. In this case where a plate-shaped rail 29 is fixed on the respective inner surfaces of the side plates 13 as shown in FIG. 1, the tray 24 is carried into a space between the support conveyer 21 at a lower location and the rail 29.

In FIG. 3, a third stopper 28 is pushed out immediately afterwards to push down a support plate 32 into the tray 24 by means of a first actuator 31 while preventing a horizontal play move of the tray 24. As a result, the support plate 32 made of urethane foam presses and fixes individual packaged articles 23 onto the bottom surface of the tray as shown in FIG. 1.

Figure 4:
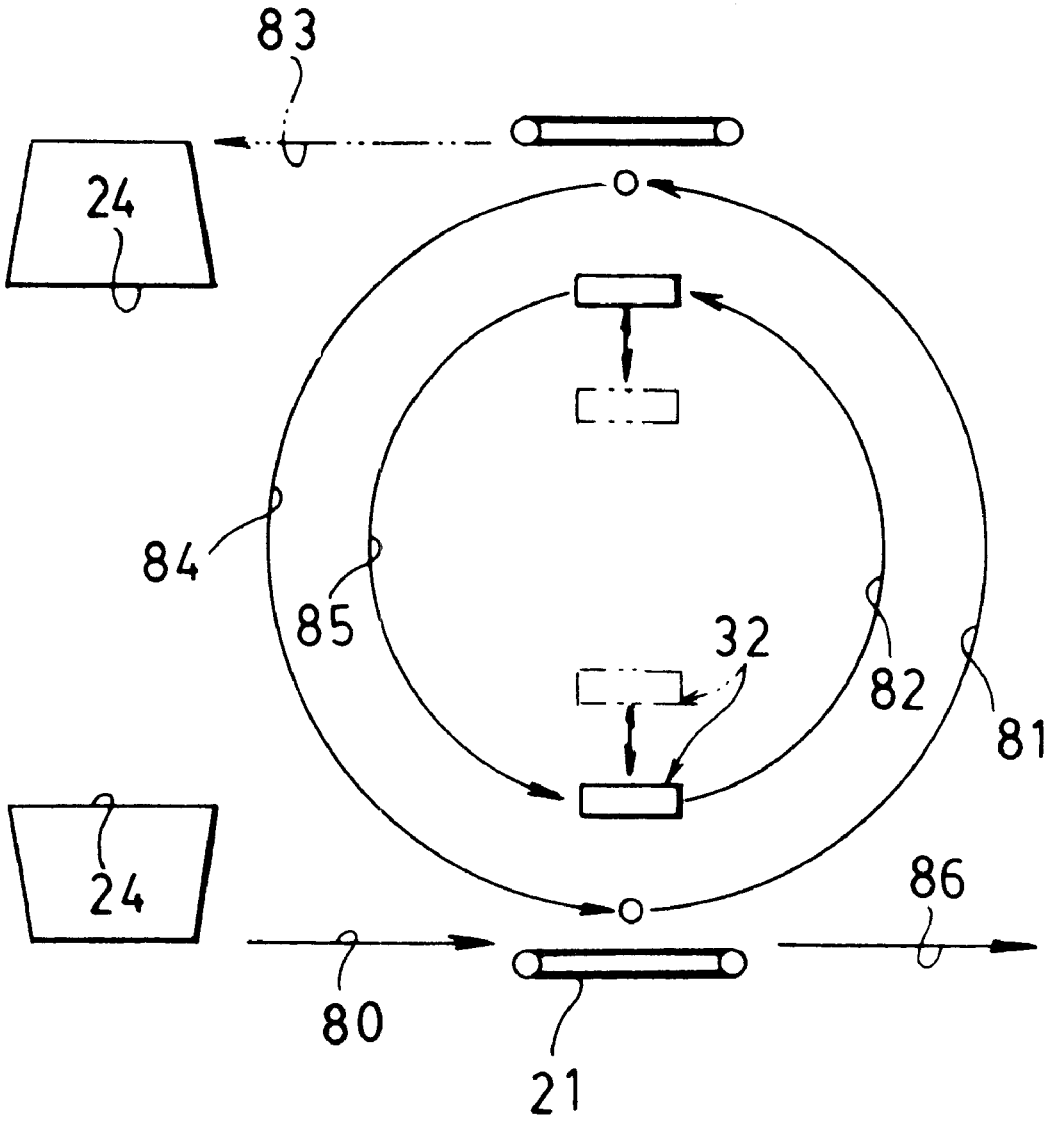
FIG. 4 is a front view illustrating an operation of the apparatus.

Subsequently, a locking pin 36 engaged with a recess 35 of the side plate shown in FIG. 3 is removed, and a second stopper 27 and a third stopper 28 are extracted. As a result, the side plate 13 rotates for 180 degrees together with the tray 24 in an arrow-headed direction 37 and halts. FIG. 4 illustrates this condition where the tray 24 rotates for 180 degrees along an arc rotating orbit shown by an arrow 81 and halts. In this case, the support plate 32 also moves along the orbit 82 while supporting the packaged articles.

When the tray 24 halts at the uppermost position of the circular orbit in an upside-down condition as shown in FIGS. 3 and 4, the support plate 32 is lowered by means of the actuator 31 and the packaged articles 23 on the support plate 32 are brought down from the inside of the tray 24. In this case, since the tray 24 is remained on the rail 29 as shown in FIG. 1, the stacked packaged articles 23 alone can be brought down from the tray 24.

Immediately afterward, a pusher cylinder 40 shown in FIG. 3 pushes a piston rod 41 to extrude to discharge the upside-down tray 24 along slanted rollers 42 toward a conveyer 43. That is, the upside-down tray 24 is discharged in the direction of an arrow 83 as in FIG. 4.

Figure 6:
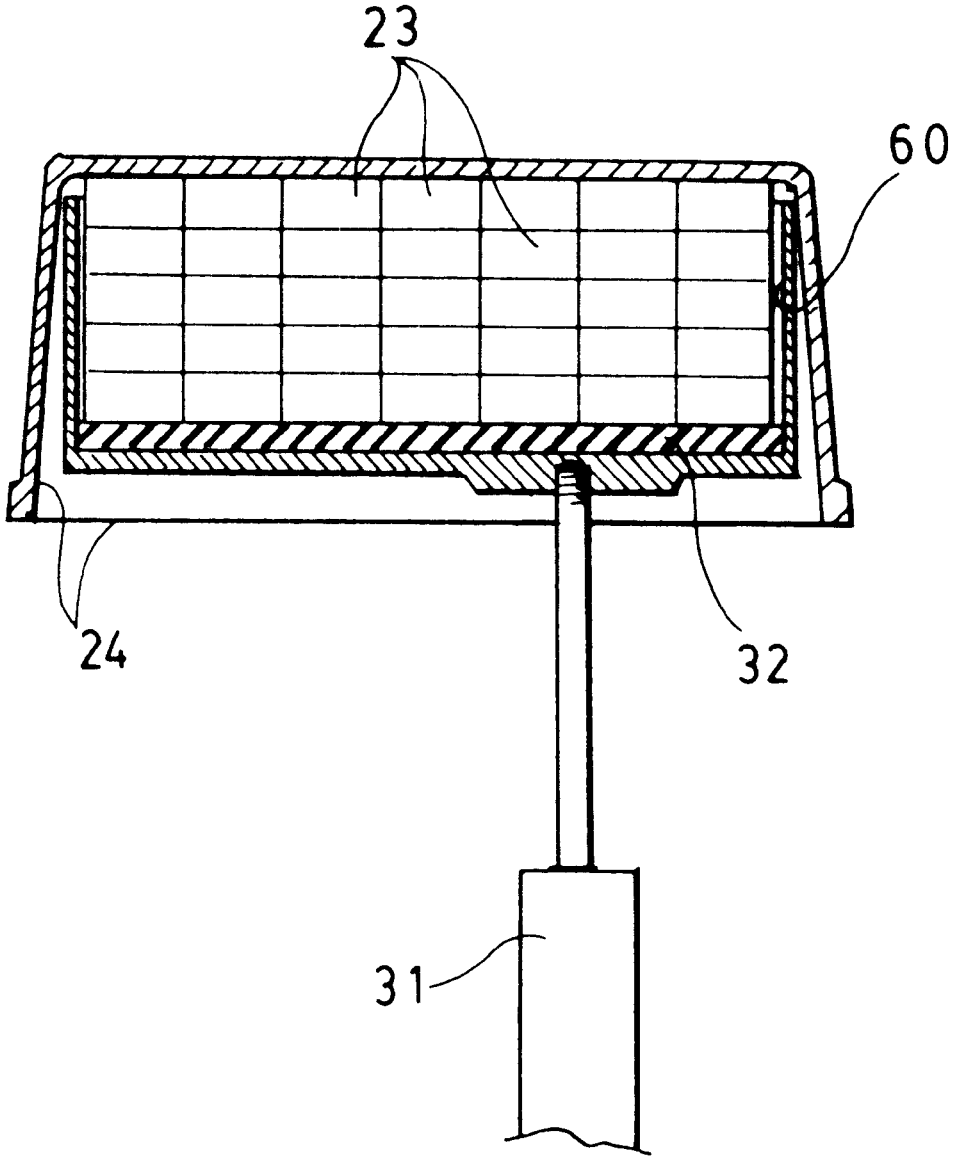
FIG. 6 illustrates means for preventing packaged articles from scattering.

Thereafter, in FIG. 3, the actuator 31 raises and pushes the packaged articles 23 loaded on the support plate 32 to the support conveyer 21, so that the packaged articles are returned to the original position 180 degrees downward by rotating the side plate 13. That is, in FIG. 4, the packaged articles move along an orbit 84 designated by an arrow 84, and at the same time the support plate 32 also moves along the orbit 85. In this case, as shown in FIG. 6, it is preferred that the support plate 32 is placed in a box 60 linked to the actuator 31 in order to prevent the packaged articles 23 from scattering.

When the side plate halts and the packaged articles are returned to the lower position in FIG. 3, the support plate 32 rises and at the same time the support conveyer 21 rotates to deliver the packaged articles toward a carry-out conveyer 44. This direction is identical with that shown by the arrow 86 in FIG. 4. Subsequent to this, a following tray 24 is conveyed onto the support conveyer 21. Since the following tray 24 is supplied each time the side plate 13 rotates for 180 degrees, the upside-down tray 24 is inevitably exhausted from beneath the support conveyer 21 at the upper location each time the following tray 24 is supplied onto the support conveyer 21 at the lower location.

FIG. 2 illustrates that the pinion 18 is linked to the large gear wheel 16 via the chain 19 to rotate the side plate 13 for 180 degrees in one direction each time. Nonetheless, when a reversible motor is used, the side plate 13 turns for 180 degrees in both positive and negative directions. In this case, a simple disk 16 may be used in place of gears such that the disk 16 and the chain 19 are linked together at one position by means of a pin 61.

Figure 5:
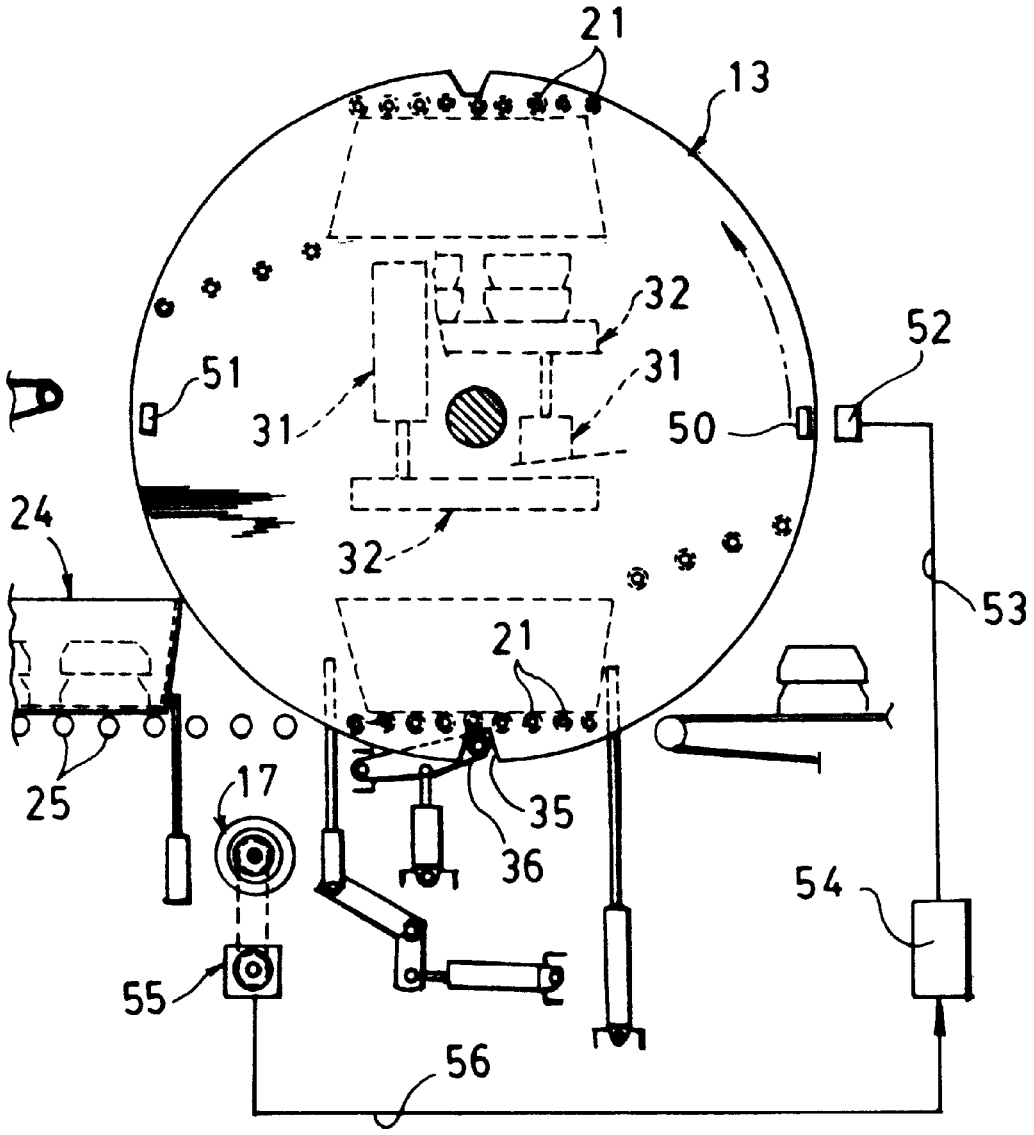
FIG. 5 is a diagram showing a configuration of an operational control system of the apparatus.

As shown in FIG. 5, a pair of switch actuating elements 50 and 51 are disposed at both symmetrical positions of the side plates 13, a switch 52 is installed at a passing area of each switch actuating element, and the switch 52 is linked to a control circuit 54 via a circuit 53. Thereupon, when the actuating element 50 on one side actuates the switch 52 to close and a resultant closing signal is transmitted to the controller 54 through the circuit 53, the locking pin 36 is engaged with the recess 35 and the rotation of the side plate 13 halts. Then, the means 25 for conveying a tray onto the support conveyer 21 moves and subsequently the actuator 31 in the side plate 13 lowers the support plate 32. Thereafter, the side plate 13 rotates for 180 degrees to discharge the upside-down tray from beneath the support conveyer 21 at the upper location, and then the side plate is rotated and the packaged articles are carried out from the support conveyer 21 at the lower location. This operational procedure is controlled on the basis of signals transmitted from the control circuit 54.

As shown in FIG. 5, a rotation angle detector 55 such as an encoder for detecting the rotation angle of the side plate is linked to the shaft of the motor 17 for driving the side plate 13 and the rotation angle detector 55 is linked to the control circuit 54 via a signal circuit 56. When the timing that the locking pin 36 is engaged with the recess 35 simultaneously as the rotation of the side plate 13 halts is read by the control circuit 54 on the basis of a pulse signal 56 from the rotation angle detector 55, firstly the means 25 for conveying a tray housing packaged articles moves to the support conveyer 21 at the lower location, next the actuator 31 in the side plate actuates the support plate, then the side plate 13 rotates for 180 degrees and the upside-down tray is discharged from beneath the support conveyer 21 at the upper location. Thereafter, the side plate is rotated and the packaged articles are carried out from the support conveyer 21 at the lower location. This operational procedure is controlled on the basis of the signals from the control circuit 54.

What is claimed is:

1. A conveying method for intermittently rotating a pair of support conveyers, consisting of a first support conveyer and a second support conveyer, for 180 degrees each time along a circular orbit around a horizontal transverse main shaft, the first and second support conveyers being symmetrically disposed 180 degrees apart with respect to the horizontal main shaft, comprising the steps of:

conveying a tray containing a plurality of packaged articles onto the first support conveyer from outside the circular orbit when the first support conveyer is at a lower position of the orbit and the second support conveyer is at an upper position of the orbit;

pressing the packaged articles into the tray by means of a support plate descending from an area above the first support conveyer;

moving said tray and said first support conveyer for 180 degrees along the circular orbit to the upper position in which the tray is upside-down while keeping the packaged articles pressed into the tray;

drawing down the packaged articles on the support plate from the tray while leaving the tray behind at the upper position;

horizontally pushing the tray that was left behind at the upper position onto a downwardly slanting guide for discharge by gravity along the guide to the outside of the circular orbit;

moving the first support conveyer 180 degrees along the circular orbit from the upper position back to the lower position while causing the support plate to press the packaged articles to the first support conveyer to return the packaged articles to the lower position; and conveying the packaged articles to the outside of the circular orbit by the action of the first support conveyer;

wherein the second support conveyer shifts 180 degrees to the lower position when the first support conveyer shifts 180 degrees to the upper position and two batches of the packaged articles are conveyed every time the first and second support conveyers rotate one round about the main shaft.

2. An apparatus, comprising:

first and second laterally spaced apart side plates integrally rotatable intermittently for 180 degrees around a horizontal transverse main shaft serving as a support shaft;

a pair of support conveyers, consisting of a first support conveyer and a second support conveyer disposed 180 degrees apart along a circular orbit around the main shaft and bridging between the side plates;

a first support plate disposed between the side plates and opposing the first support conveyer and a second support plate disposed between the side plates and opposing the second support conveyer;

a conveying means for conveying a tray from outside the orbit onto the first support conveyer when the first support conveyer is at a lower position and a first rail fixed to an inner surface of the first side plate and a second rail fixed to an inner surface of the second side plate;

a support plate actuator for pushing the first support plate into the tray to press a plurality of packaged articles inside the tray while the side plates rotate the first support conveyer for 180 degrees from the lower position to an upper position and thereafter lowering the first support plate together with the packaged articles to the outside of the tray while the tray is disposed upside-down at the upper position;

means for discharging the tray while upside-down along the rails with the packaged articles left behind being supported on the first support plate;

means for rotating the side plates for 180 degrees while pressing the packaged articles on the first support plate to the first support conveyer by means of the actuator after the tray has been discharged to return the first support conveyer and the packaged articles to the lower position; and means for conveying the packaged articles returned to the lower position by operation of the first support conveyer.

3. The apparatus as set forth in claim 2, further comprising:

a pair of switch actuators provided at both symmetrical positions on the side plates;

a switch provided at a passing area of the switch actuators; and a control circuit responsive to a closing signal from the switch, wherein an operating procedure of conveying the tray onto the first support conveyer at the lower position, rotating the side plates, actuating the switch actuators on the side plates, discharging the tray located in an upside-down position from beneath the first support conveyer at the upper position, and conveying the packaged articles from the first support conveyer is controlled on the basis of signals from the control circuit.

4. The apparatus as set forth in claim 2, further comprising:

a rotation angle detector for measuring a rotation angle of the side plates; and a control circuit responsive to a signal from the rotation angle detector, wherein an operating procedure of conveying the tray onto the first support conveyer, rotating the side plates, actuating the support plate actuator on the side plates, discharging the tray located in an upside-down position from below the first support conveyer at the upper position, and conveying the packaged articles from the first support conveyer at the lower position is controlled on the basis of signals from the control circuit.

5. The apparatus as set forth in claim 2, wherein means for discharging the tray while upside-down comprise:

a pusher cylinder with a piston rod for pushing out the tray while upside-down, provided outside the first side plate at the same level as the upper position and extending horizontally in a perpendicular direction to the main shaft;

a discharge conveyer for receiving and discharging outside the tray while upside-down and pushed out, provided outside the second side plate; and a pair of slanted roller groups arranged symmetrically with respect to the main shaft between the side plates and allowing the tray while upside-down and pushed out to slide, under its own gravitational force, onto the discharge conveyer for receiving and discharging the tray pushed out.

* * * * *